US006340102B1

(12) United States Patent
Su

(10) Patent No.: US 6,340,102 B1
(45) Date of Patent: Jan. 22, 2002

(54) SEALING VALVE STRUCTURE FOR LIQUID SPRAYERS

(76) Inventor: Cheng-Yuan Su, 124, Section 4, Tung Ta Road, Hsinchu (TW)

( * ) Notice: Subject to any disclaimer, the term of this patent is extended or adjusted under 35 U.S.C. 154(b) by 0 days.

(21) Appl. No.: 09/252,971

(22) Filed: Feb. 19, 1999

(51) Int. Cl.[7] ..... B65D 88/54
(52) U.S. Cl. ..... 222/321.2; 222/321.9
(58) Field of Search ..... 222/402.2, 321.9, 222/385, 321.2

(56) References Cited

U.S. PATENT DOCUMENTS 3,362,344 A * 1/1968 Duda ..... 222/321.9
4,089,442 A * 5/1978 Hafale et al. ..... 222/321
4,735,347 A * 4/1988 Schultz et al. ..... 222/321
5,791,527 A * 8/1998 Giuffredi ..... 222/321.9
5,894,963 A * 4/1999 Hirota ..... 222/321.9

* cited by examiner

*Primary Examiner*—Gregory L. Huson
*Assistant Examiner*—Melvin Cartagena
(74) *Attorney, Agent, or Firm*—Dougherty & Troxell

(57) ABSTRACT

An improved sealing valve structure for liquid sprayers, in particular an improvement directed to an enclosed space formed in an interior of a valve of a manually operable sprayer or atomizer, essentially an improvement of the structure of a tightening valve and a movable valve, includes a tightening valve disposed below a compression chamber and capable of interaction with a movable valve, the tightening valve being integrally formed with a cylinder so that they are concentric and have enhanced durability to prevent loosening and failure of the tightening valve due to prolonged subjection to the action of the movable valve. An edge of an inner periphery of the tightening valve is provided with a projecting annular tightening end that achieves good tightness and smoothness during interaction with the movable valve so as to enhance their mutual tightness, stability and smoothness. The movable valve has a stepped pressure bearing portion, and a lower sleeve portion for receiving a spring to achieve a stable tension effect.

1 Claim, 4 Drawing Sheets

SEALING VALVE STRUCTURE FOR LIQUID SPRAYERS

BACKGROUND OF THE INVENTION (a) Field of the Invention

The present invention relates to an improved sealing valve structure for liquid sprayers or atomizers, more particularly an improvement directed to the structure of a compression chamber formed in an interior of a valve of a manually operable sprayer, in which a tightening valve disposed below a compression chamber and capable of interaction with a movable valve is integrally formed with a cylinder so as to enhance the concentricity, stability, and durability of the tightening valve and the cylinder and to prevent loosening and failure of the tightening valve due to prolonged subjection to the reciprocating friction action of the movable valve. Furthermore, the movable valve has a stepped pressure bearing surface and a lower sleeve portion for receiving a spring to achieve a stable tension effect.

(b) Description of the Prior Art

For conventional sprayers or atomizers, especially those for spraying perfume, in addition to the quality of the aromatic material used for the perfume, whether the sprayers or atomizers are light and compact to use, whether the sprayers' response to the user's manipulation is sensitive, and whether the spraying effect is satisfactory, all of them are important factors that determine whether they can attract users. Hence, sprayers or atomizers of excellent quality and good spraying effects receive more and more attention today.

Generally speaking, in use, when the sprayer is being pressed, the sprayed amount should be controllable within a determined range, not excessive or not inadequate, so that the user can spray a desired amount of perfume onto a certain part of his/her body. In other words, the sprayer should enable the user to determine whether to press the sprayer once, twice, or thrice to obtain the desired amount. It is, therefore, very important to control the amount of perfume sprayed at each pressing of the sprayer, which involves the stable output of perfume at each operation. A sprayer or atomizer that can spray perfume in stages in response to a light pressure thereon is an excellent sprayer or atomizer.

FIG. 1 shows a liquid sprayer disclosed in U.S. Ser. No. 4,735,347. The liquid sprayer in said patent comprises a movable valve A, an upper end piston element B, a lower end cylinder portion C, a tightening valve D, an elastic element E, and an outer fitting element F. The movable valve A includes an upper solid rod portion A1 and a lower hollow sleeve portion A2. The rod portion A1 is divided into three sections according to the thickness thereof, namely, a first rod portion A11, a second rod portion A12, and a third rod portion A13. The upper end piston element B and the lower end cylinder portion C cooperatively form a cylinder K. The tightening valve D is mounted in the lower end cylinder C portion and is elastically tightened on an outer wall of the movable valve A to achieve a water-stopping effect. The movable valve A is disposed inside the cylinder K at the upper section. The elastic element E at the lower section generates an elastic tension with respect to the movable valve A. And inside the cylinder K, the space confined by the tightening valve D and the upper end piston element B is a compression chamber Z adapted to suck in a liquid, compress it, and eject it.

When the sprayer is being pressed downwardly, the movable valve A and the upper end piston element B are brought to displace synchronously downward. When an outer periphery B2 of the upper end piston element B displaces downwardly along an inner wall of the lower end cylinder portion C, and when an outer periphery at the lowermost section of the sleeve portion A2 of the movable valve A is in contact with the tightening valve D that has a diameter slightly smaller than the periphery of the sleeve portion A2, an enclosed space is formed. Besides, the capacity of the compression chamber Z is gradually decreasing. If the pressing action continues, the lower end cylinder C will displace further downwardly so that the pressure borne by the liquid inside the compression chamber Z increases. As a result, the liquid stored in the compression chamber 7 flows speedily upwardly along the gap between the rod portion A1 and the wall of the upper end piston element B and exerts a pressure on the second rod portion A12 and the third rod portion A13 of the movable valve A, so that the movable valve displaces downwardly and causes the liquid to thrust instantly to a nozzle B1 to be sprayed out in a mist form.

The question of concern herein is that in order that the tightening vale D provided in the lower end cylinder portion C can tightly couple with the movable valve A, shoulders formed at where the two rod portions meet are configured to be pressure concentration points to allow the liquid to press the movable valve A downwardly when the sprayer is being pressed. The object of a configuration as such is to cause the movable valve A to resist the resetting tension of the elastic element E in a more sensitive manner and displace instantly downward, so that a top end of the first rod portions A11 disengages from a valve port B101 that is originally in tightly contact therewith, thereby allowing the high-pressure liquid to eject from the nozzle B1 of the piston element B.

A primary condition to allow ejection of liquid when the sprayer is subjected to pressure is that a compression chamber has to be provided, which should be able to eject the liquid when subjected to pressure. Besides, when the compression chamber is emptied of the liquid, an equal amount of liquid has to be drawn into the compression chamber. In addition, the compression chamber has to be sealed tight. When the liquid is sprayed out in mist form, an opening should be formed at an upper end of the compression chamber to allow ejection of the liquid. During the process of drawing in the liquid, the lower end thereof should also form an opening to allow suction of liquid therein. Regarding the control of the drawing in of the liquid, it is the action of the tightening valve D in the lower end cylinder portion C that cooperates with the movable valve A to achieve closure or opening, in particular, the tightening action of an inner peripheral flange D1 on the periphery of the tightening valve D and the movable valve A. The inner peripheral flange D1 extends upwardly at an inclined angle. When the liquid in the compression chamber 2 is pressed and is filled with pressure, the inner peripheral flange D1 will become more closed with respect to the movable valve A. If the liquid inside the compression chamber Z is discharged and is in a virtually vacuum state, the liquid is sucked into the compression chamber Z from a lower portion of the sprayer container as in a pumping action.

It can therefore be seen that whether a determined amount of liquid can be successfully pressed out of or drawn into the compression chamber in a stable manner is hinged upon whether the tightening valve D can provide a sealing effect. According to the above-described structure, the tightening valve D is an independent element disposed on the bottom portion of the compression chamber Z. If the installation or coupling thereof is defective and it becomes loosened, the compression chamber Z cannot be positively sealed, and the spraying and suction actions are affected.

Furthermore, the sensitivity of the movable valve A determines the magnitude of force required to press the sprayer. In the structure as described above, the second and third rod portions A12, A13 of the movable valve A form a stepped surface, which makes the pressure bearing surface area narrow and slanting and affects the sensitivity of the movable valve A. Hence, the pressing operation is not smooth.

SUMMARY OF THE INVENTION

Therefore, a primary object of the present invention is to provide an improved sealing valve structure for liquid sprayers, in which a tightening valve is integrally formed with a cylinder so that the precision of their concentricity is enhanced to prevent loosening of the tightening valve. The parts are standardized so that manufacturing and assembly costs are reduced. Furthermore, the tightening valve is provided with a projecting annular tightening end at an edge of an inner periphery thereof so that it has enhanced tightness, smoothness, and stability.

Another object of the present invention is to provide an improved sealing valve structure for liquid sprayers, in which a movable valve has an upper end provided with a stepped pressure bearing portion so that a liquid inside a compression chamber can react quickly when subjected to pressure to cause the movable valve to retract, thereby allowing ejection of the liquid. And besides, the pressing action is very smooth compared to the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
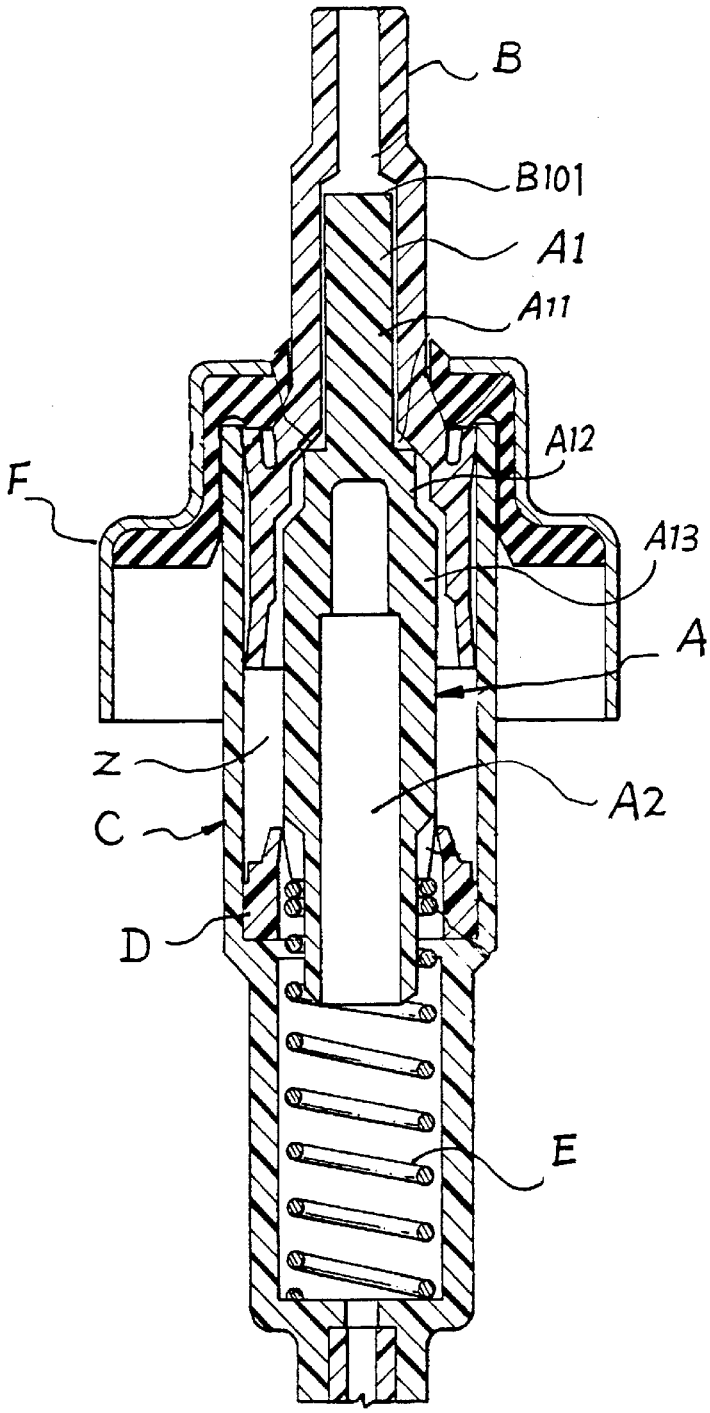
Fig. 1 PRIOR ART
FIG. 1 is an assembled sectional view of the device taught in U.S. Pat. No. 4,735,347.
Figure 2:
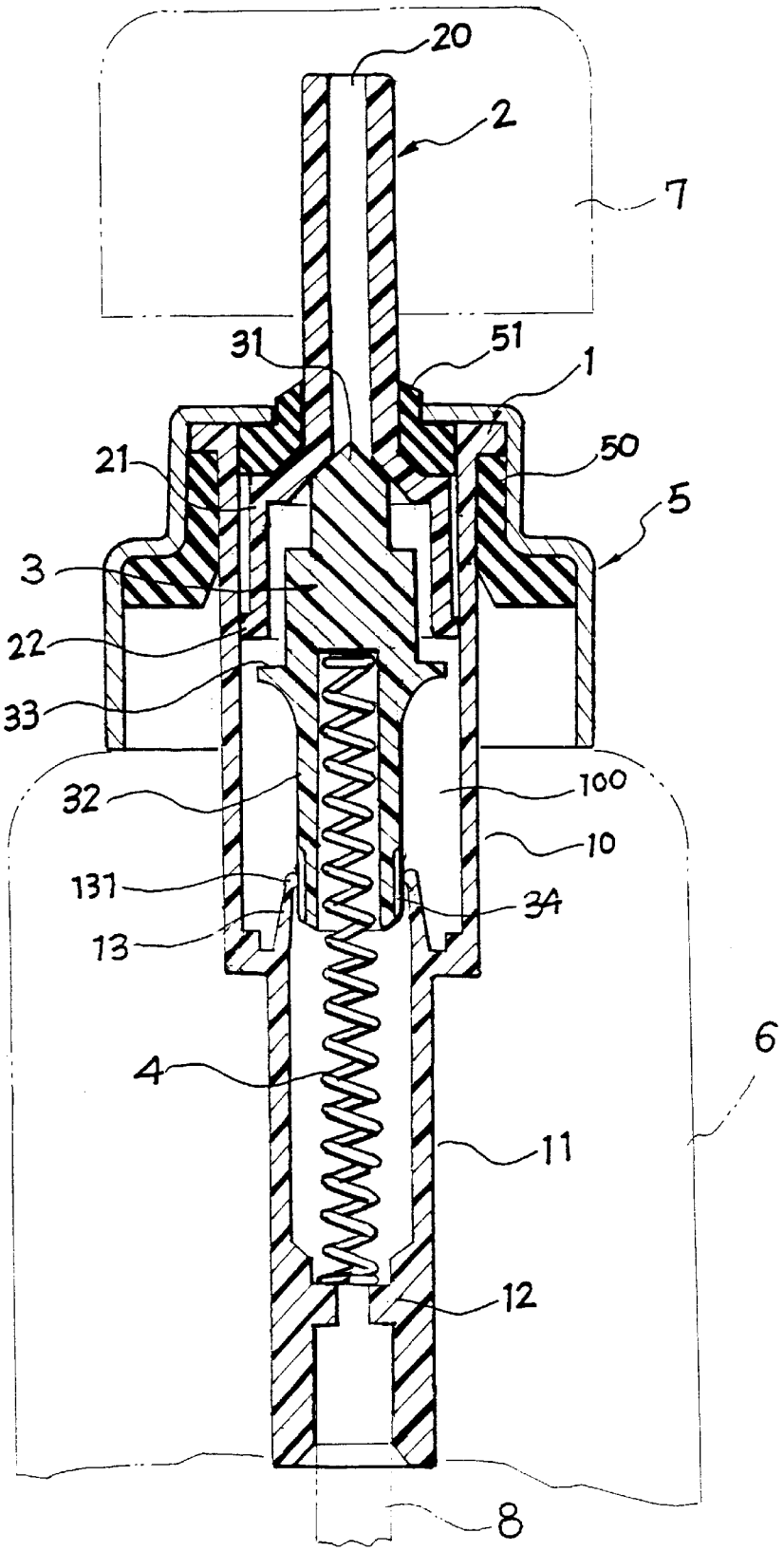
FIG. 2 is an assembled sectional view of the present invention.

Reference is made to FIG. 2, which is an assembled sectional view of the present invention (without a nozzle 7 at a top end), a preferred embodiment of an improved sealing valve structure for liquid sprayers or atomizers according to the present invention comprises a cylinder 1, a press element 2, a movable valve 3, a spring 4, and a securing element 5.

The cylinder 1 is a tubular structure of two sections of different diameters. The cylinder includes an upper end portion 10 of a larger diameter and a lower end portion of a smaller diameter. The upper end portion 10 is communicated with the lower end portion 11. A tightening valve 13 extends integrally from where the upper end portion 10 joins the lower end portion 11. The tightening valve 13 extends obliquely along a periphery of an inner hole of the lower end portion 11 towards the upper end portion 10 in a tapering form. An edge portion of the taper is configured to be a projecting annular tightening end 131 adapted to tighten and seal the movable valve 3. A stop portion 12 is provided at a lower portion of the lower end portion 11 to receive the spring 4 and to generate an upward tension with respect to the movable valve 3 and the press element 2. The lower portion of the lower end portion 11 is further provided with a connecting hole adapted to connect to a straw 8 that can extend to a bottom portion of a container 6.

The press element 2 is also a two-section tubular element that connects the nozzle 7 above and abuts against the movable valve 3 below. The press element 2 includes an upper section forming a channel 20 adapted for ejection of liquid, and a lower section forming a flared, cup-shaped hood orifice 21. An edge of the hood orifice 21 projects outwardly to form a projecting ring 22. The press element 2 is disposed at the upper end portion 10 of the cylinder 1. The projecting ring 22 in the present invention resembles an O-ring with respect to the upper end portion 10 of the cylinder 1, and is adapted to enclose the upper end portion 10 of the cylinder 1 to form a compression chamber 100.

The movable valve 3 is a stepped rod of concentric rod portions. The movable valve 3 includes an upper end forming a conical end 31, a lower end forming a sleeve portion 32, and a two-step planar pressure bearing portion 33 provided between the conical end 31 and the sleeve portion 32. The conical end urges upwardly against the channel 20 of the press element 2, whereas the sleeve portion has one end of the spring 4 fitted therein. The tension of the spring 4 forces the movable valve 3 above to urge against the press element 2. A plurality of axially extending suction holes is provided on an outer side of a bottom end of the sleeve portion 32. When the movable valve 3 is located in an uppermost position, the position of the suction holes 34 allows the liquid to pass through the tightening valve 13 into the compression chamber 100.

After assembly of the cylinder 1, the press element 2, the movable valve 3, and the spring 4, the securing element 5 is used to couple the assembly with the container 6. The securing element 5 is a stepped housing of a small thickness, and includes a plastic container stopper 50 and a valve plug 51. The plastic container stopper 50 is capable of achieving water-tightness and is disposed between the securing element 5 and the mouth of the container 6. The valve plug 51 is disposed between the securing element 5 and the press element 2. By means of the securing element 5, the components of the sprayer can be coupled firmly and leakage of liquid prevented.

Figure 3:
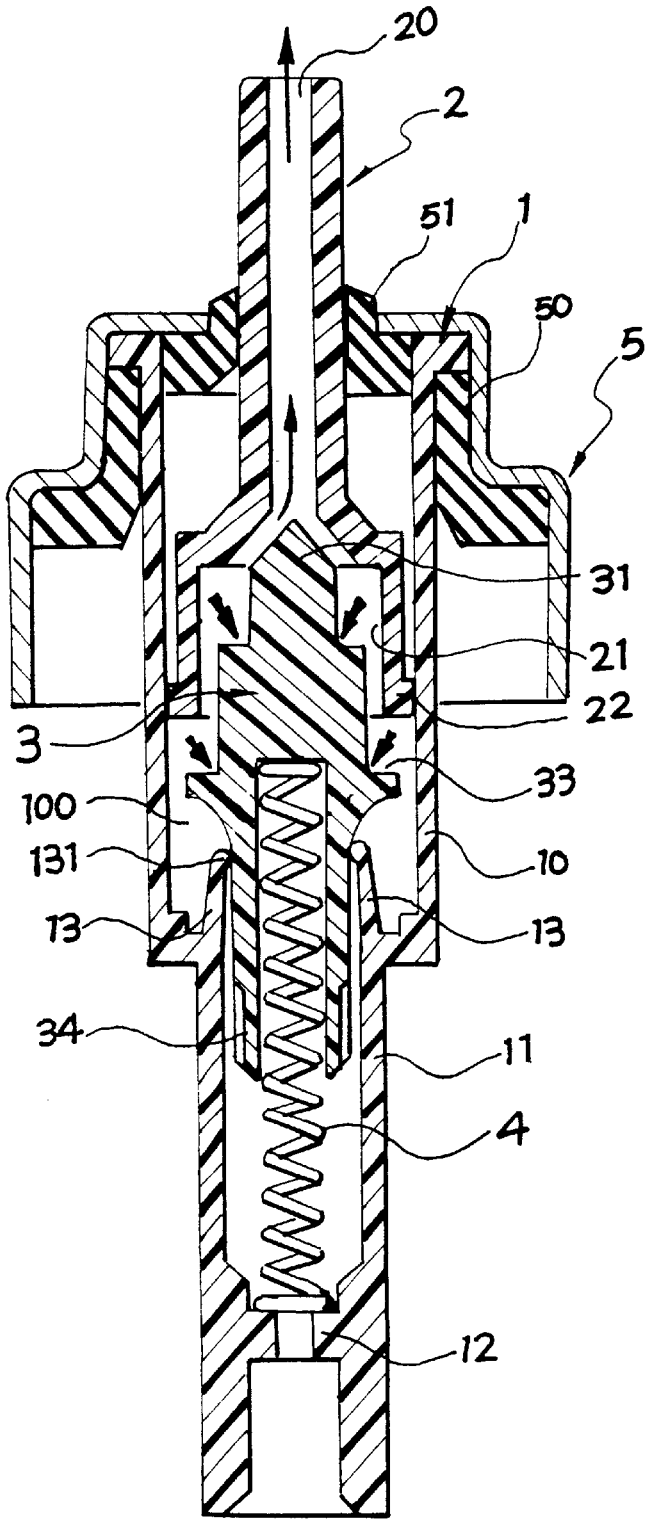
FIG. 3 is a schematic view illustrating the operation of the present invention.

Referring to FIG. 3, when the press element 2 is subjected to a downward pressure, the hood orifice 21 and the projecting ring 22 of the press element 2 compress gradually the space of the compression chamber 100 in the upper end portion 10 of the cylinder 1. At the same time, the movable valve 3 also displaces downwardly therewith, so that the position of the suction holes 34 is away from the tightening valve 13, allowing the tightening valve 13 and the movable valve 3 to become tightly sealed, whereby the compression chamber 100 is tightly enclosed. Due to the compression caused by the hood cover 21, the only way out for the liquid in the compression chamber 100 is the joint between the conical end 31 of the movable valve 3 and the channel 20. Therefore, when the pressure of the liquid is larger than the tension of the spring 4, the joint between the conical end 31 and the channel 20 becomes separated to form an outlet, and the liquid, of a high pressure, can travel at a high speed to the nozzle 7 to be ejected in a mist form.

During the process of pressing and ejection, due to the enhanced tightness and the quick response of the pressure bearing portion 33 of the movable valve 3, the movable valve 3 can displace quickly downward to open the channel, a light and fine mist can be achieved.

Figure 4:
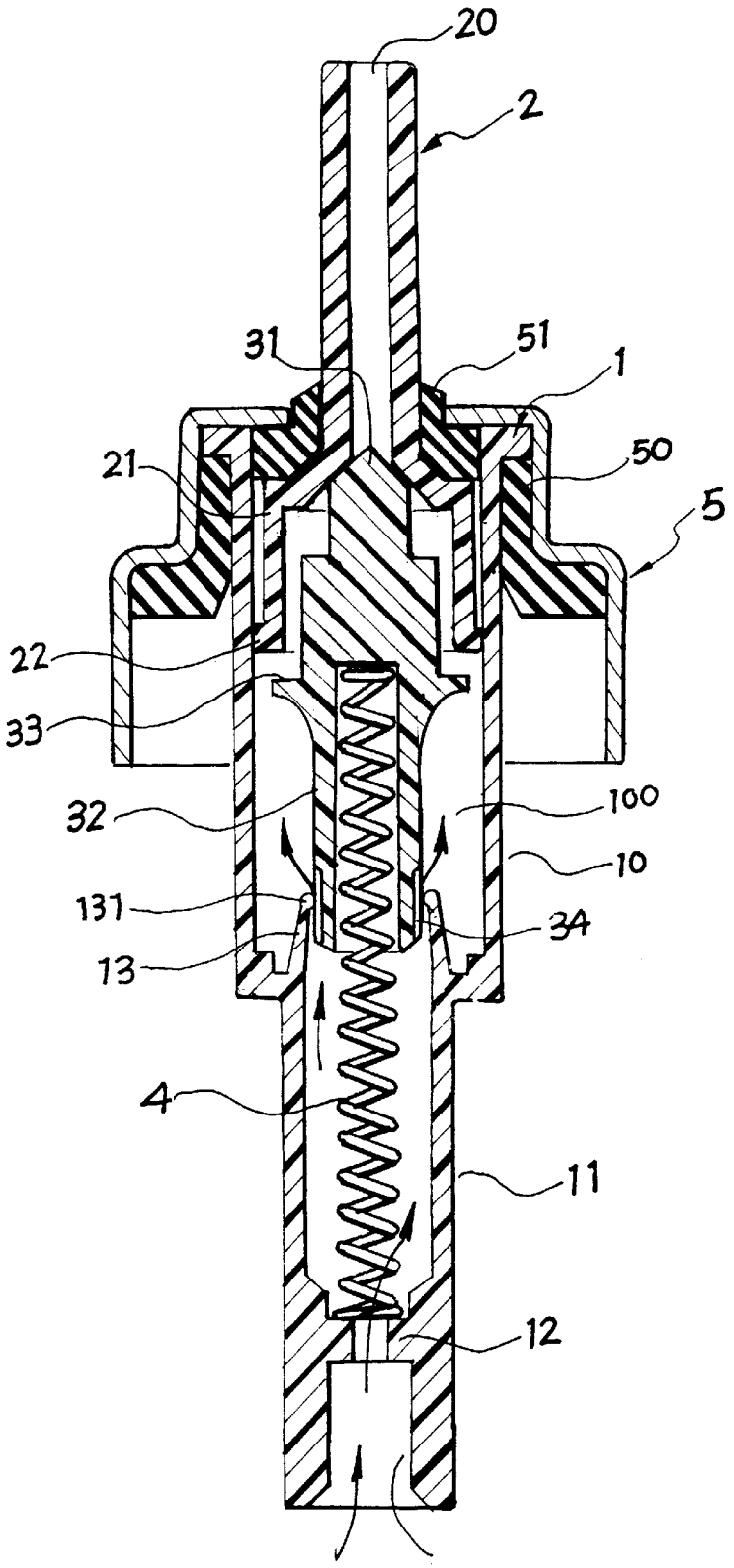
FIG. 4 is another schematic view illustrating the operation of the present invention.

Referring to FIG. 4, when the nozzle 7 is released after one pressing operation, due to the resetting action of the spring 4, the movable valve 3 and the press element 2 are sprung upwardly, causing the pressure inside the compression chamber 100 to be lower than that of the outside. When the movable valve 3 elevates, and the suction holes 34 pass through the tightening valve 13, the liquid will naturally be drawn into the compression chamber 100 to get ready for the next pressing operation.

In summary, the present invention has the following advantages:

1. The tightening valve 13 and the cylinder 1 are integrally formed so that they are concentric and have enhanced durability. This prevents loosening and failure of the tightening valve resulted from long subjection to the friction caused by the reciprocating action of the movable valve 3.
2. The projecting annular tightening end 131 at the edge of the inner periphery of the tightening valve 13 allows for good tightness and smoothness during the interaction of the tightening valve 13 and the movable valve 3. This enhances their tightness, stability, and smoothness.
3. The area of the pressure bearing surface of the upper end face of the movable valve 3 is larger than that of the lower end face by about 125%. Hence, the movable valve 3 can react quickly when subjected to the pressure of the liquid and displace downwardly to allow opening of the nozzle to allow ejection of the liquid.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved sealing valve structure for liquid sprayers, comprising a cylinder, a press element, a movable valve, a spring, and a securing element, wherein:

said cylinder is a tubular structure including an upper end portion of a larger diameter and a lower end portion of a smaller diameter, said upper end portion being communicated with said lower end portion, a tightening valve being integrally formed and extending from where said upper end portion joins said lower end portion, said tightening valve extending obliquely along a periphery of an inner hole of said lower end portion towards said upper end portion in a tapering form, an edge portion of said taper being configured to be a projecting annular tightening end adapted to tighten and seal said movable valve, a stop portion being provided at a lower portion of said lower end portion to receive said spring and to generate an upward tension with respect to said movable valve and said press element, said lower portion of said lower end portion being further provided with a connecting hole adapted to connect to a straw that can extend to a bottom portion of a container;

said press element is a two-section tubular element that connects a nozzle above and abuts against said valve below, said press element including an upper section forming a channel for ejection of liquid, and a lower section forming a flared, cup-shaped hood orifice, an edge of said hood orifice projecting outwardly to form a projecting ring, said press element being at said upper end portion of said cylinder, said projecting ring serving as an O-ring for said upper end portion of said cylinder, and being adapted to enclose said end portion of said cylinder to form a compression chamber; and said movable valve is a stepped rod of concentric rod portions, said movable valve including an upper end forming a conical end, a lower end forming a sleeve portion, and a two-step planar pressure bearing portion provided between said conical end and said sleeve portion, said conical end urging upwardly against said channel of said press element, said sleeve portion having one end of said spring fitted therein, said spring forcing said movable valve to urge against said press element, a plurality of axially extending suction holes being provided on an outer side of a bottom end of said sleeve portion such that when said movable valve is located in an uppermost position, said suction holes allow the liquid to pass through said tightening valve into said compression chamber.

* * * * *